US005962203A

United States Patent [19]

Tsoi et al.

[11] Patent Number: 5,962,203

[45] Date of Patent: Oct. 5, 1999

[54] FOGGING SOLUTION FOR A REVERSAL PROCESS

[75] Inventors: Siu C. Tsoi, Watford; Peter J. Twist, Gt. Missenden, both of United Kingdom; David T. Southby, Rochester, N.Y.

[73] Assignee: Eastman Kodak Company, Rochester, N.Y.

[21] Appl. No.: 09/130,411

[22] Filed: Aug. 6, 1998

[30] Foreign Application Priority Data

Aug. 6, 1997 [GB] United Kingdom ..... 9716554

[51] Int. Cl.[6] ..... G03C 5/50

[52] U.S. Cl. ..... 430/449; 430/379; 430/407; 430/409; 430/410; 430/489

[58] Field of Search ..... 430/449, 489

[56] References Cited

U.S. PATENT DOCUMENTS 5,156,940 10/1992 Kok et al. ..... 430/440

*Primary Examiner*—Hoa Van Le

*Attorney, Agent, or Firm*—J. Lanny Tucker

[57] ABSTRACT

A new fogging photographic processing solution for a reversal process comprises a compound (I) and a bi-nucleophilic agent. Compound (I) corresponds to the following formula:

wherein A is a group capable of being adsorbed to the silver halide surface, L is a linking group and r is 0 or 1, $R_1$ and $R_2$ are independently selected from an alkyl group, substituted or unsubstituted, and an aryl group substituted or unsubstituted. A process of producing a positive image by imagewise exposure of a reversal silver halide material comprises contacting the material with the above fogging solution or by imagewise exposure of such a material containing a compound (I) and contacting the material with a solution comprising a bi-nucleophilic agent.

12 Claims, 8 Drawing Sheets

FOGGING SOLUTION FOR A REVERSAL PROCESS

FIELD OF THE INVENTION

The present invention relates to a new fogging photographic processing solution for a reversal process. The present invention also concerns a process of producing a positive photographic image by imagewise exposure of a photographic reversal material, the reversal step being carried out with the new fogging solution of the present invention.

BACKGROUND OF THE INVENTION

In conventional color photography, photographic products contain three superimposed units of silver halide emulsion layers, one to form a latent image corresponding to exposure to blue light (blue-sensitive), one to form a latent image corresponding to exposure to green and one to form a latent image corresponding to exposure to red.

During photographic processing, the developing agent reduces the silver ions of each latent image. The thus-oxidized developing agent then reacts in each unit with a dye-forming coupler to produce yellow, magenta and cyan dye images respectively from the recordings in blue, green and red. This produces negative color images.

The reversal photographic products that enable positive images to be obtained comprise the same three superimposed units of silver halide emulsion layers, each of these units containing respectively a yellow, magenta and cyan dye-forming coupler. In the usual photographic reversal process for producing positive color image, after exposure, the reversal photographic product is first developed with a first black-and-white developing bath (latent image development), then it is uniformly exposed and the exposed material is subjected to a second development with a color developing bath. The process is completed by fixing and bleaching the color photographic material.

It is known to replace the uniform exposure by using a chemical fogging agent that is added at the latest to the second development. Compounds known as fogging agents are, for example, boranocarbonates, borohydrides, alkylamino-boranes, tin(II) compounds and thioureas.

One of the drawbacks of some of the fogging agents commonly used is that they are unstable in solution. Some of these compounds cause instability of the color developing bath when carried over from the fogging bath into the color developing bath. The use of some of these compounds is strictly controlled for ecological reasons.

It is therefore an object of the present invention to find a new chemical fogging solution for a photographic reversal process that reduces or substantially obviates the disadvantages of the known chemical fogging agents.

SUMMARY OF THE INVENTION

According to the present invention there is provided a photographic processing solution for a reversal process comprising a compound (I) and a bi-nucleophilic agent, wherein the compound (I) corresponds to the following formula:

(I)

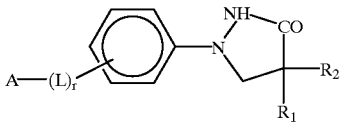

wherein

A is a group capable of being adsorbed to the silver halide surface,

L is a linking group and r is 0 or 1, and $R_1$ and $R_2$ are independently selected from an alkyl group, substituted or unsubstituted, and an aryl group, substituted or unsubstituted.

The present invention further provides a process of processing a positive photographic image by imagewise exposure of a photographic reversal silver halide material, comprising the step of contacting the photographic material with the solution of the present invention.

The present invention also provides a process of producing a positive photographic image by imagewise exposure of a photographic reversal silver halide material, the reversal material containing a compound (I) as defined above, comprising the step of contacting the photographic material with a photographic solution comprising a bi-nucleophilic agent.

It has been found surprisingly, that the compound (I), when associated with a bi-nucleophilic agent, acts as a fogging agent. Unexpectedly, the fogging activity of the compound (I) in the presence of a bi-nucleophilic agent increases as less of the compound (I) is used except at very low levels of compound (I).

BRIEF DESCRIPTION OF THE DRAWINGS

For a better understanding of the present invention, reference will now be made, by way of example only, to the accompanying drawings in which

FIG. 1 illustrates the results from a composition comprising hydroxylamine and a compound (I) compared to a control composition without a compound (I).

FIG. 2 illustrates the results from a time-of-development series for a composition comprising hydroxylamine and a compound (I) compared to a control composition without a compound (I).

FIG. 3 illustrates the results from a composition (a) being a control comprising hydroxylamine but no compound (I)(b) containing both hydroxylamine and compound (I) and (c) containing compound (I) but no hydroxylamine.

FIG. 4 illustrates the results from a composition comprising hydroxylamine and a compound (I) showing the effect of reversal.

FIG. 5 illustrates the results from a time-of-development series for a composition comprising hydroxylamine and a compound (I) compared to a control composition without a compound (I).

FIG. 6 illustrates the results from a control composition comprising no compound (I) with three compositions wherein a compound (I) is added after different intervals of time.

FIG. 7 illustrates the results from incorporating a compound (I) at three different levels in an emulsion layer, the developer containing hydroxylamine but no compound (I).

FIG. 8 illustrates the results from incorporating a compound (I) at three different layers in an emulsion layer, the developer containing neither hydroxylamine nor a compound (I).

DETAILED DESCRIPTION OF THE INVENTION

Figure 1:
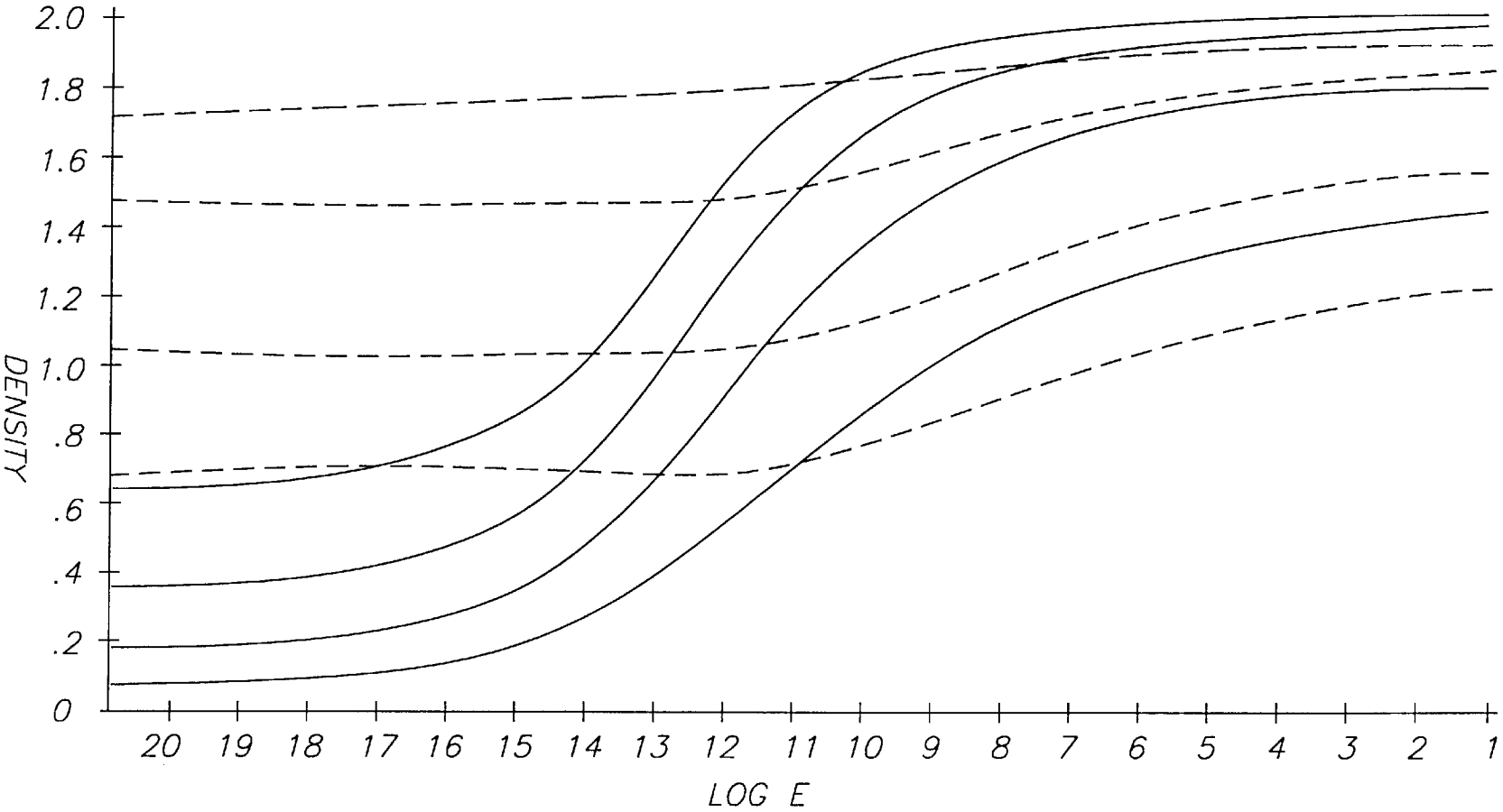
FIGS. 1 to 8 are the graphs which illustrate the sensitometric results obtained from the solutions of the present invention and comparative solutions exemplified in the examples of the invention.

According to the present invention, $R_1$ and $R_2$ of the above formula (I) may independently be an alkyl group having from 1 to 12 carbon atoms, which may be substituted or unsubstituted. The alkyl groups include straight or branched chain unsaturated or saturated alkyl groups or cycloalkyl groups. According to a preferred embodiment, $R_1$ and $R_2$ are independently an alkyl group having from 1 to 4 carbon atoms.

As substituents of the alkyl groups, a large number of substituent groups can be contemplated. For example, the substituent can be hydroxy, alkoxy, carboxy, amino, amido, carbamoyl, sulfonamido and sulfamoyl, each of these being capable of further substitution, e.g., with an alkyl group.

The alkyl groups can be for example methyl, ethyl, or propyl, especially methyl or ethyl.

Alternatively, $R_1$ and $R_2$ may independently be an aryl group, especially a phenyl group, optionally substituted in particular by one or more halogen, alkyl or alkoxy groups.

The group A capable of being adsorbed to the silver halide surface defines a group well known in the photographic field. For example, A can be selected from thioureas, triazoles, benzotriazoles, mercaptotetrazoles, mercaptoimidazoles, mercaptothiazoles, mercaptooxazoles, mercaptotriazoles, indazoles, imidazoles, benzimidazoles and thioethers. According to one embodiment, A is a benzotriazole group.

The linking group L can be alkylene, —CO—, —CO—O—, —O—CO—, —CONR—, —NRCO—, —$SO_2$NR—, —NR$SO_2$—, where R=H, alkyl or aryl; —O—, —O—$(CH_2)_n$—O— or —O—$(CH_2)_n$—O—CO—, where n=1–5.

According to a specific embodiment, L is in particular the group —O—CO, linked via the oxygen atom to the phenyl group in formula (I), the linking group being hydrolyzable in developer solutions. Accordingly, the compound (I) when present in the developer is hydrolyzed which results in the deactivation of the nucleating ability of the compound after a period of time, for example after a period of time from 15 seconds to one hour, i.e., it self-destructs.

In the scope of the present invention, a bi-nucleophilic agent is an agent that comprises two active nucleophilic sites. A bi-nucleophilic agent is for example hydroxylamine, hydrogen peroxide, hydrazine or substituted hydrazine. According to one embodiment, the bi-nucleophilic agent is hydroxylamine. Indeed, it is advantageous to use hydroxylamine as the bi-nucleophilic agent since hydroxylamine is generally already present in developing solutions in order to prevent oxidation of the solution.

According to one embodiment, both the compound (I) and the bi-nucleophilic agent are present in a processing solution. Such a processing solution can be, for example, a fogging solution or a color developing solution. In this embodiment, the amount of the bi-nucleophilic agent is from $1\times10^{-3}$ M to 0.3 M, preferably $6\times10^{-3}$ M to 0.12 M, more preferably $1.2\times10^{-2}$ M to 0.06 M. The amount of compound (I) is from $3\times10^{-7}$ M to $3\times10^{-3}$ M, preferably $3\times10^{-6}$ M to $3\times10^{-5}$ M.

According to another embodiment, the compound (I) can be incorporated in the reversal photographic material, whereas the binucleophilic agent is present in a processing solution. In this embodiment, the amount of the bi-nucleophilic agent is as defined hereinabove and the coverage of compound (I) is from $1\times10^{-6}$ mol/m$^2$ to $3\times10^{-3}$ mol/m$^2$, preferably $10^{-5}$ mol/m$^2$ to $10^{-4}$ mol/m$^2$.

The reversal photographic processing conventionally comprises a black-and-white developing step, a reversal step, a color developing step, a bleaching step, a fixing step and one or more washing steps. The bleaching step and the fixing step can be combined in a single bleach-fixing step.

Black-and-white developers are well known and include a silver halide reducing agent such as an aminophenol, a polyhydroxybenzene, e.g., hydroquinone and its derivatives, a 3-pyrazolidone, a pyrogallol, pyrocatechol and ascorbic acid. Black-and-white developers have been described in *Research Disclosure*; September 1994, No 36544 (called thereafter Research Disclosure), Section XIX.A.

Color developers comprise compositions that, in their oxidized form, react with a color coupler to form an image dye, the coupler being present either in the developer or in the photographic material.

Preferred color developing agents are p-phenylene diamines. Especially preferred are 4-amino-3-methyl-N,N-diethylaniline hydrochloride, 4-amino-3-methyl-N-ethyl-N-β-(methanesulfonamido)ethylaniline sulphate hydrate, 4-amino-3-methyl-N-ethyl-N-β-hydroxyethylaniline sulfate, 4-amino-3β-(methanesulfonamido)ethyl-N,N-diethylaniline hydrochloride and 4-amino-N-ethyl-N-(2-methoxyethyl)-m-toluidine di-p-toluene sulfate.

Developers can contain a large number of materials. They can contain preservatives, antifogging agents, chelating agents for avoiding calcium or magnesium precipitation, etc. Materials that can be used in the developer baths were described in detail in *Research Disclosure*, Section XIX.

The bleaching baths conventionally contains metallic ions chelated with aminopolycarboxylic acids such as chelated Fe(III), Co(III), Cr(VI), Cu(II), etc. Compounds useful for bleaching baths are disclosed in *Research Disclosure*, Section XXA.

The fixing bath consists of complexing non-exposed silver halides to form soluble complexes, such complexes being eliminated by washing. The compounds useful for the fixing step are disclosed in *Research Disclosure*, Section XXB. Such compounds are conventionally thiosulfates such as ammonium thiosulfate.

The bleaching solution and the fixing solution can be combined in a single solution called a bleach-fixing solution. Such a solution is disclosed in *Research Disclosure*, Section XXC.

The reversal photographic processing can include one or more additional steps such as washing steps, stabilizing steps or stopping steps as disclosed in *Research Disclosure*, Section XXD.

The emulsions useful for the present invention can be prepared according to different methods known and described in *Research Disclosure*, Section I-C.

The hydrophilic colloidal binder frequently used to manufacture the emulsions is generally gelatine or a gelatine derivative. This gelatine can be replaced in part by other synthetic or natural hydrophilic colloids such as albumen, casein, zeïn, a polyvinyl alcohol, cellulose derivatives such as carboxymethylcellulose for example. Such colloids are described in Section II of *Research Disclosure*.

The silver halide emulsions of the present invention can be chemically sensitized as described in *Research Disclosure*, Section IV. In a conventional fashion, the emulsions are sensitized with sulfur, selenium and/or gold. It is also possible to sensitize the emulsions chemically by reduction.

The silver halide emulsions can be sensitized spectrally as described in *Research Disclosure*, Section V. The conventional sensitizing dyes are polymethine dyes, which comprise cyanines, merocyanines, complex cyanines and merocyanine, oxonols, hemioxonols, styryls, merostyryls, streptocyanines, hemicyanines and arylidenes.

The color photographic product of the invention comprises in a conventional fashion dye-forming couplers with 2 or 4 equivalents. These couplers react with the color developer in its oxidized form to form respectively a cyan, magenta or yellow image dye. These couplers are generally colorless and non-diffusible. According to another known embodiment, these couplers are contained in the development bath. Couplers that can be used are described in *Research Disclosure*, Section X.

In addition to the compounds cited previously, the photographic product can contain other useful photographic compounds, for example coating aids, stabilizing agents, plasticizers, anti-fog agents, tanning agents, antistatic agents, matting agents, etc. Examples of these compounds are described in *Research Disclosure*, Sections VI, VII, VIII, X.

The supports that can be used in photography are described in Section XV of *Research Disclosure*; Section XV. These supports are generally polymer supports such as cellulose, polystyrene, polyamide or polyvinyl polymers, polyethylene or polyester, paper or metal supports.

The photographic products can contain other layers, for example a protective top layer, intermediate layers, an antihalation layer, an anti-UV layer, an antistatic layer, etc. These different layers and their arrangements are described in Section XI of *Research Disclosure*. In addition to the emulsions described above, the product of the invention can contain other emulsions known in the field of photography.

Examples of compounds within formula (I) include the following:

N1

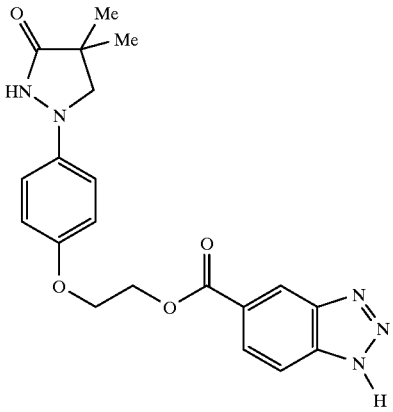

N2

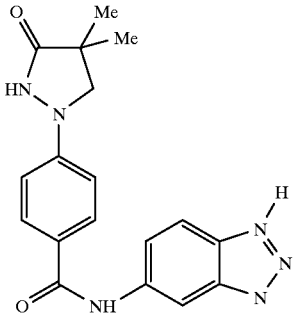

-continued

N3

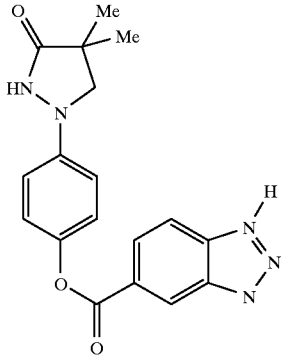

N4

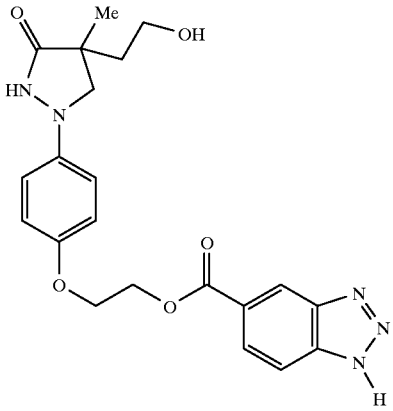

N5

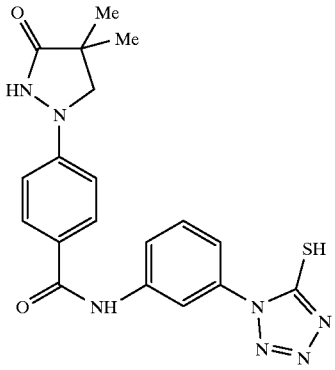

N6

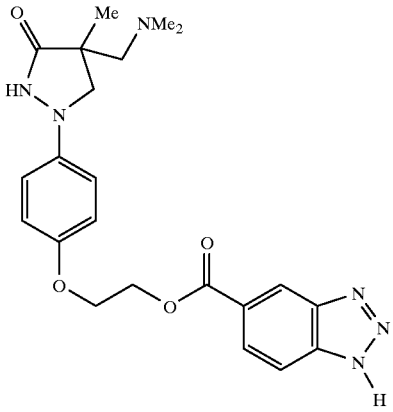

-continued

N7

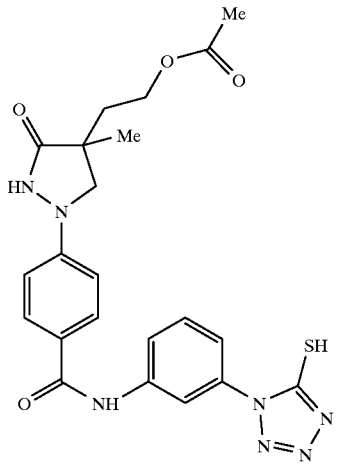

N8

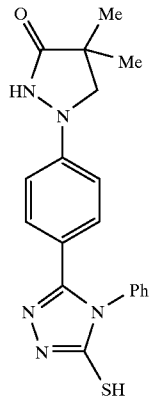

N9

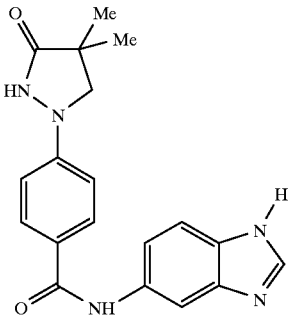

The following examples illustrate the present invention in greater detail.

A monochrome photographic material with the coating structure (CN1) shown below was used in all the examples.

| Coating structure (CN1) |
|---|
| super-coat gelatin (1.0 g/m$^2$) |
| Gelatin (2.2 g/m$^2$) Cyan Image Coupler (0.6 g/m$^2$) |
| Silver Halide (1.0 g/m$^2$) |
| ////////////////////////////////////////////////// |
| Cellulose Acetate Support |

where the silver halide is a 400ASA iodo-bromide tabular grain emulsion with 4% iodide.

EXAMPLE 1 (Control)

Film strips having the above (CN1) structure were processed in the developer of the composition shown above (Table 1). A time-of-development series was run for 2, 3.25, 5 and 8 minutes, represented on FIG. 1 by curves a, b, c and d respectively.

TABLE 1

| Developer composition | |
|---|---|
| Potassium carbonate(anhydrous) | 37.5 g/l |
| Sodium sulfite (anhydrous) | 4.25 g/l |
| Potassium iodide | 1.2 mg/l |
| Sodium bromide | 1.3 g/l |
| Hydroxylamine sulphate | 2,0 g/l |
| Anti-calcium agent | 6.5 ml/l |
| Color developing agent | 4.5 g/l |
| pH | 10 |

where the anti-calcium agent is a 40% (w/w) aqueous solution of the penta sodium salt of diethylene triamine penta-acetic acid.

The process cycle was as follows:

| | |
|---|---|
| Developing step | 1 to 8 minutes |
| Bleaching step | 2 minutes |
| Fixing step | 2 minutes |
| Washing step | 2 minutes |
| Drying | |

where the bleaching step was carried out with a KODAK C-41® bleach(II) solution, and the fixing step with KODAK C-41b® fixing solution.

In FIG. 1, the solid lines are the sensitometric responses for the control process as described above.

EXAMPLE 2

Film strips having the above (CN1) structure were processed with the developer composition of Table 1 except that 7 mg/l of the compound N1 was added to the developer composition. A time-of-development series was run for 2, 3.25, 5 and 8 minutes, represented by curves a, b, c and d respectively.

In FIG. 1, the dashed lines are the sensitometric responses obtained from a developer composition containing the compound N1 and hydroxylamine as bi-nucleophilic agent in accordance with the present invention.

It can be seen from the solid lines and dashed lines of FIG. 1 that the N1 addition provides a fogging effect (increase of the $D_{min}$).

EXAMPLE 3

Film strips having the above (CN1) structure were processed with the developer composition of Example 2 wherein different levels of the compound N1 were added (from 0.01 mg/l to 35 mg/l).

The results for a 5 minute development time are shown in Table 2 below.

TABLE 2

| (N1)mg/l | Dmin |
|---|---|
| 0 | 0.36 |
| 0.01 | 0.34 |
| 0.1 | 0.42 |
| 0.5 | 1.37 |
| 2.3 | 1.62 |
| 7 | 1.48 |
| 10 | 0.91 |
| 35 | 0.64 |

Here it can be suprisingly that as the level of N1 is decreased down to about 2 mg/l the fogging action actually increases.

EXAMPLE 4

In this example, film strips having the above (CN1) structure were processed with the developer composition of Table 1 except that the compound N2 was added at a level of 10 mg/l. A time-of-development series was run for 1, 2.5, 5 and 8 minutes represented by curves a, b, c and d respectively.

Figure 2:
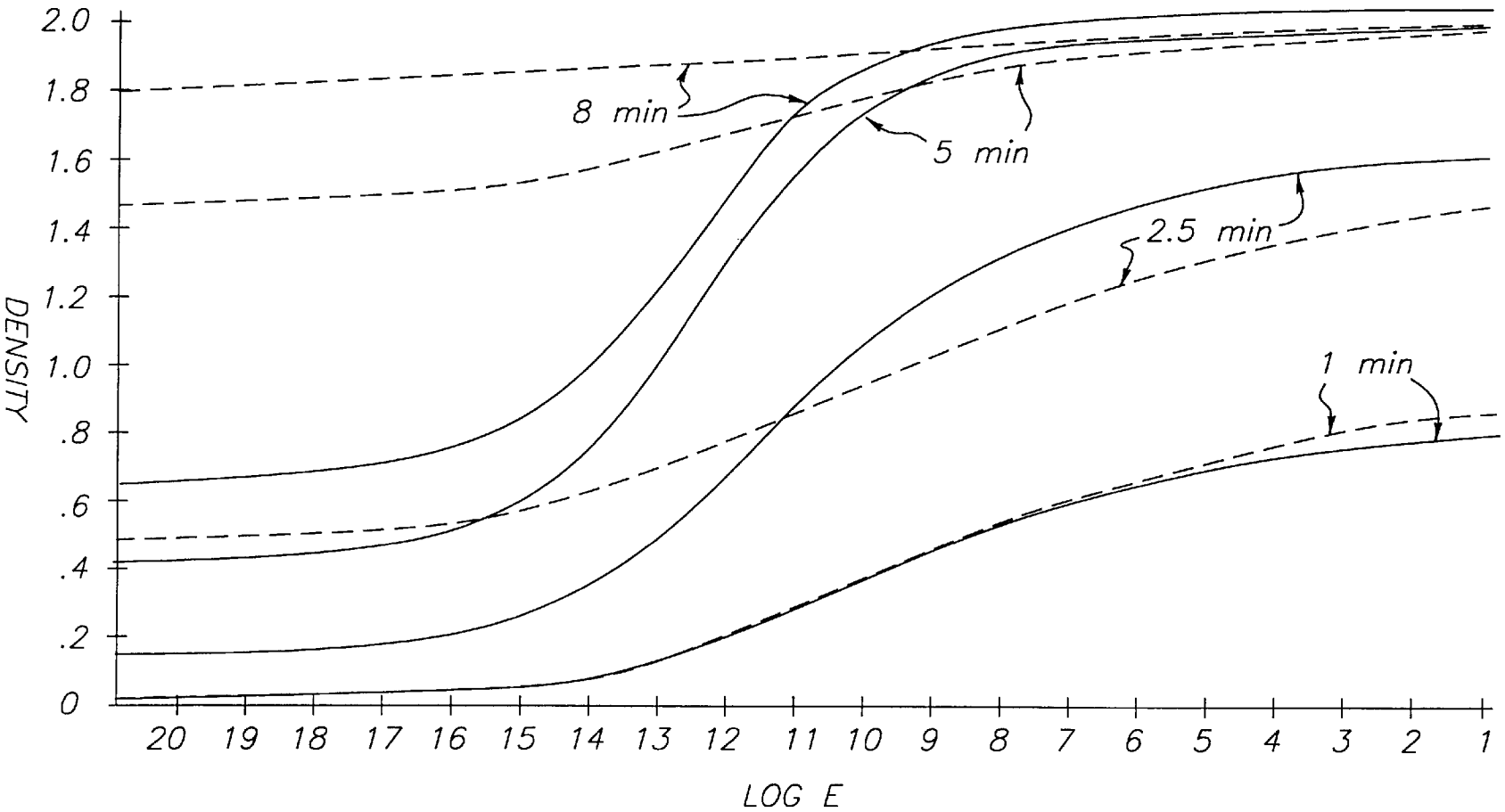

The results are shown in FIG. 2 where the solid curves are obtained from the developer composition N2 (i.e., control) and the dashed curves are obtained with the developer composition containing N2. The fogging effect of the composition of the present invention containing N2 and hydroxylamine as bi-nucleophilic agent can be observed at the three longer times.

EXAMPLE 5

A film strip having the above (CN 1) structure was processed with the developer composition of Table 1 (control).

A second film strip having the above (CN1) structure was processed with the developer composition of Example 4 wherein the amount of the compound N2 was 3 mg/l. The film strip was processed for a 2.5 minute development time.

A third film strip having the above (CN1) structure was processed with the developer composition containing N2 (3 mg/l) but free of hydroxylamine.

Figure 3:
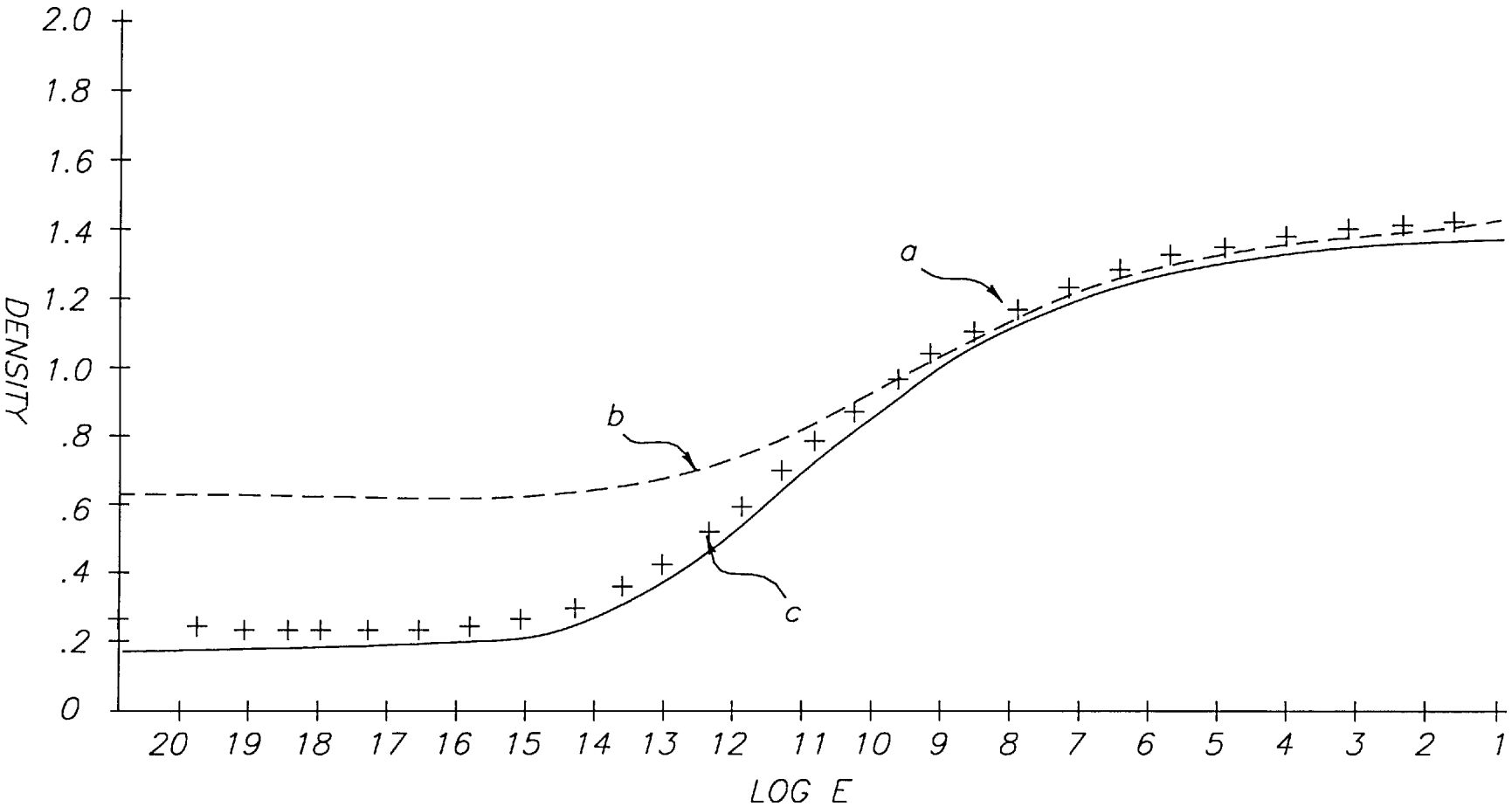

The sensitometric results are shown in FIG. 3 where the solid line (a) is obtained from the developer composition of Table 1 (control), the dashed line (b) is obtained from the developer composition of Example 4 containing 3 mg/l of N2 (invention) and the dotted line (c) is obtained from the developer composition of Example 4 containing 3 mg/l of N2 but free of hydroxylamine (comparative), all is for a 2.5 minutes development time.

A comparison of lines (a) and (b) shows the fogging action of N2. The line (c) is very close to the control line (a) demonstrating that the fogging action is no longer operating. This shows clearly that the presence of hydroxylamine was necessary in this example for there to be a fogging effect.

EXAMPLE 6

In this example, a film strip having the above CN1 structure is processed with a color reversal processing, which comprises the following steps:

| | |
|---|---|
| Black-and-white development | 1 minute |
| Wash | 2 minutes |
| Color development and reversal | 5 minutes |
| Bleach | 2 minutes |
| Fix | 2 minutes |
| Wash | 2 minutes |
| Dry | |

where the bleach and fix are the same as used in Example 1 and the color developer has the composition shown below.

| Color developer composition | |
|---|---|
| $K_2HPO_4,3H_2O$ | 40.0 mg/l |
| Sodium bromide | 0.65 g/l |
| Hydroxylamine sulphate | 2.0 g/l |
| Anti-calcium agent | 6.5 ml/l |
| Color developing agent | 10.0 g/l |
| Compound N2 | 3 mg/l |
| pH | 11.7 |

The black-and-white developer was Kodak Readymatic® Developer.

Figure 4:
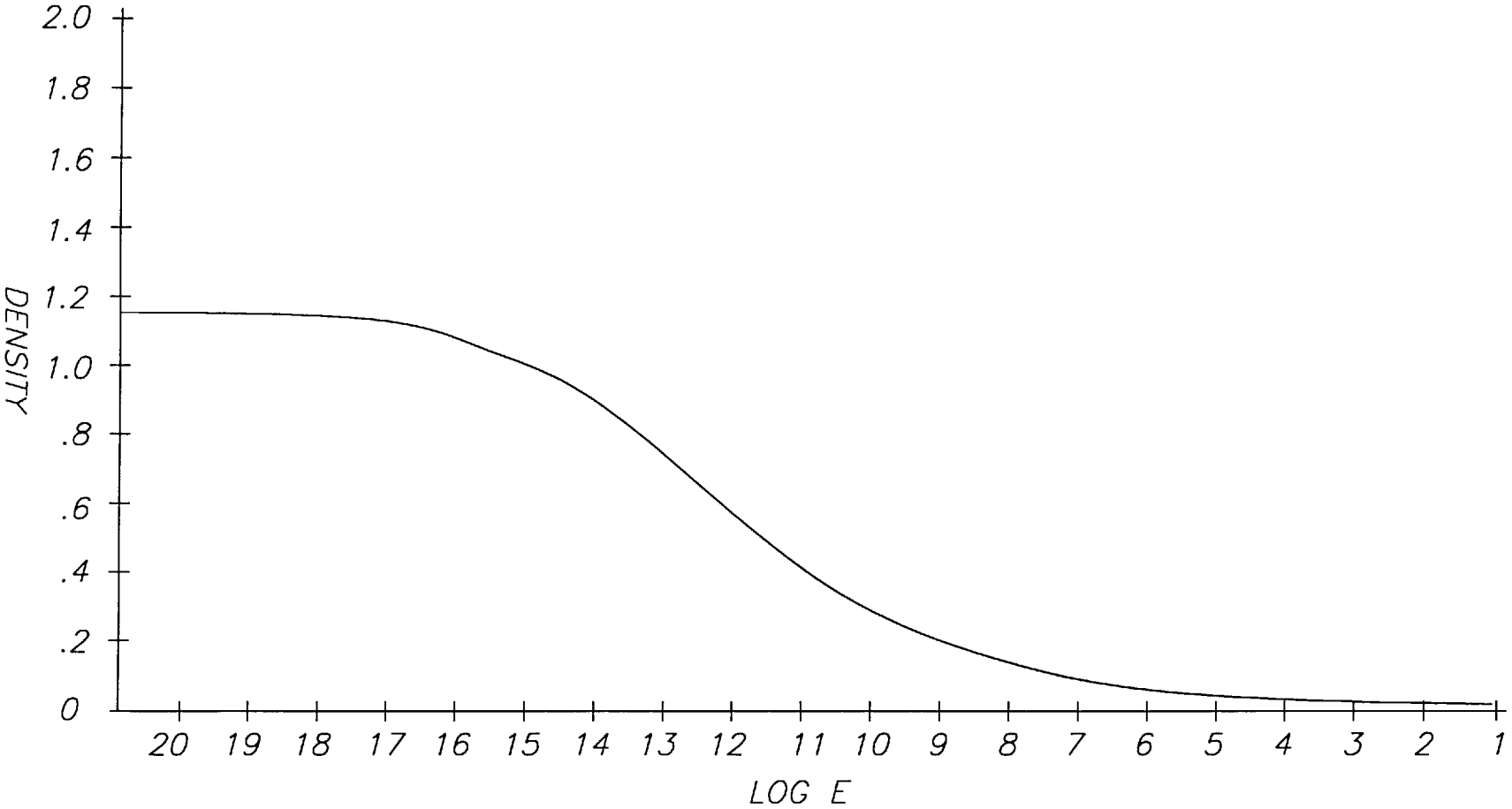

The sensitometric result is shown in FIG. 4. Here it can be seen that the reversal has been effective.

EXAMPLE 7

In this example, a film strip having the above (CN1) structure was processed with the developer composition of Table 1 (control). A second film strip was processed with a developer solution of Table 1 except that N3 was added at a level of 10 mg/l. A time-of-development series was run for 1, 2.5, 5 and 8 minutes, represented by curves a, b, c and d respectively.

Figure 5:
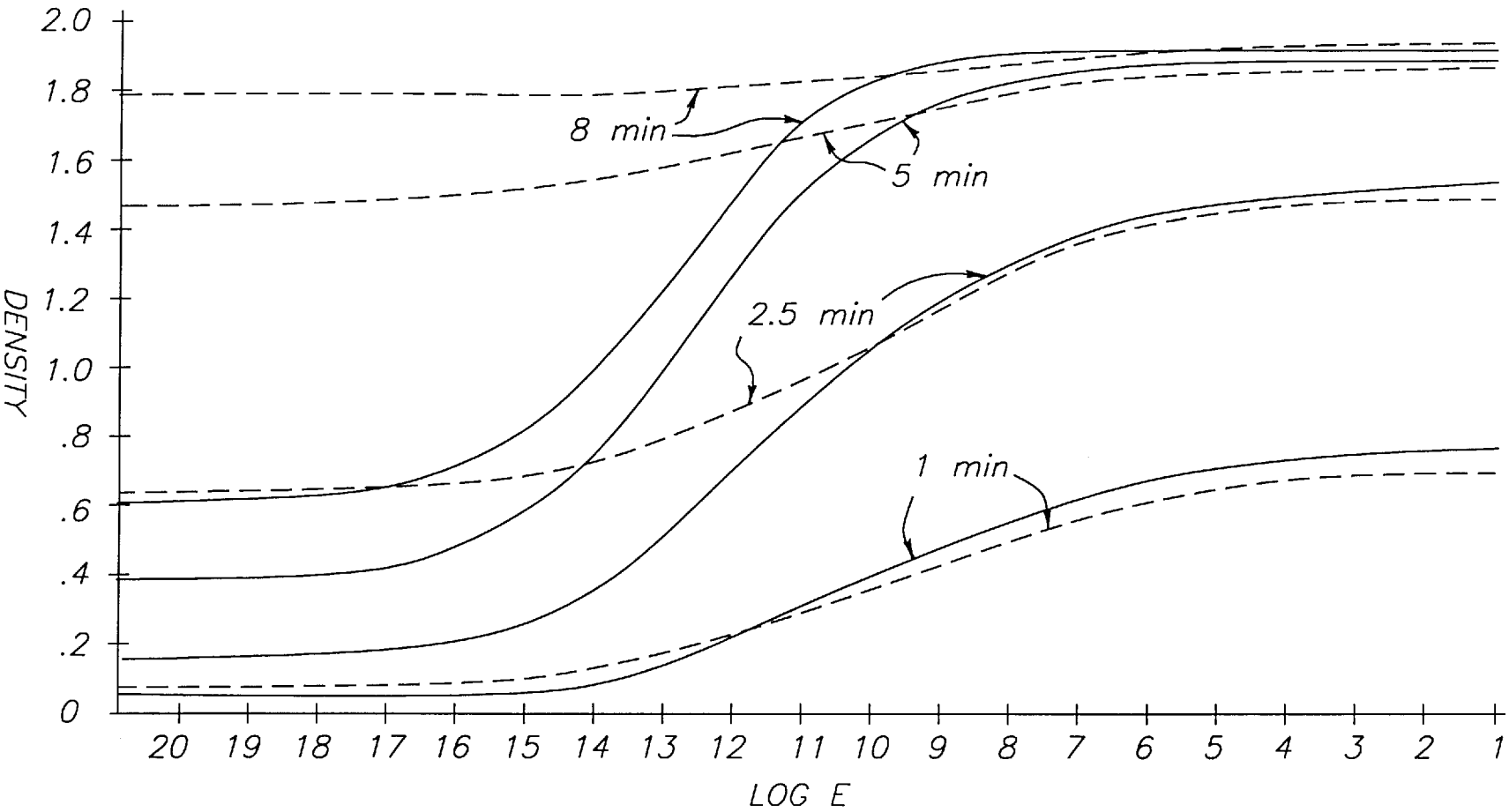

The results are shown in FIG. 5 where the solid lines are obtained with a developer composition of Table 1 (control), the dashed lines are obtained from a developer solution containing N3 (invention). Here the fogging ability of the compound N3 at the three longer times can be seen.

EXAMPLE 8

Figure 6:
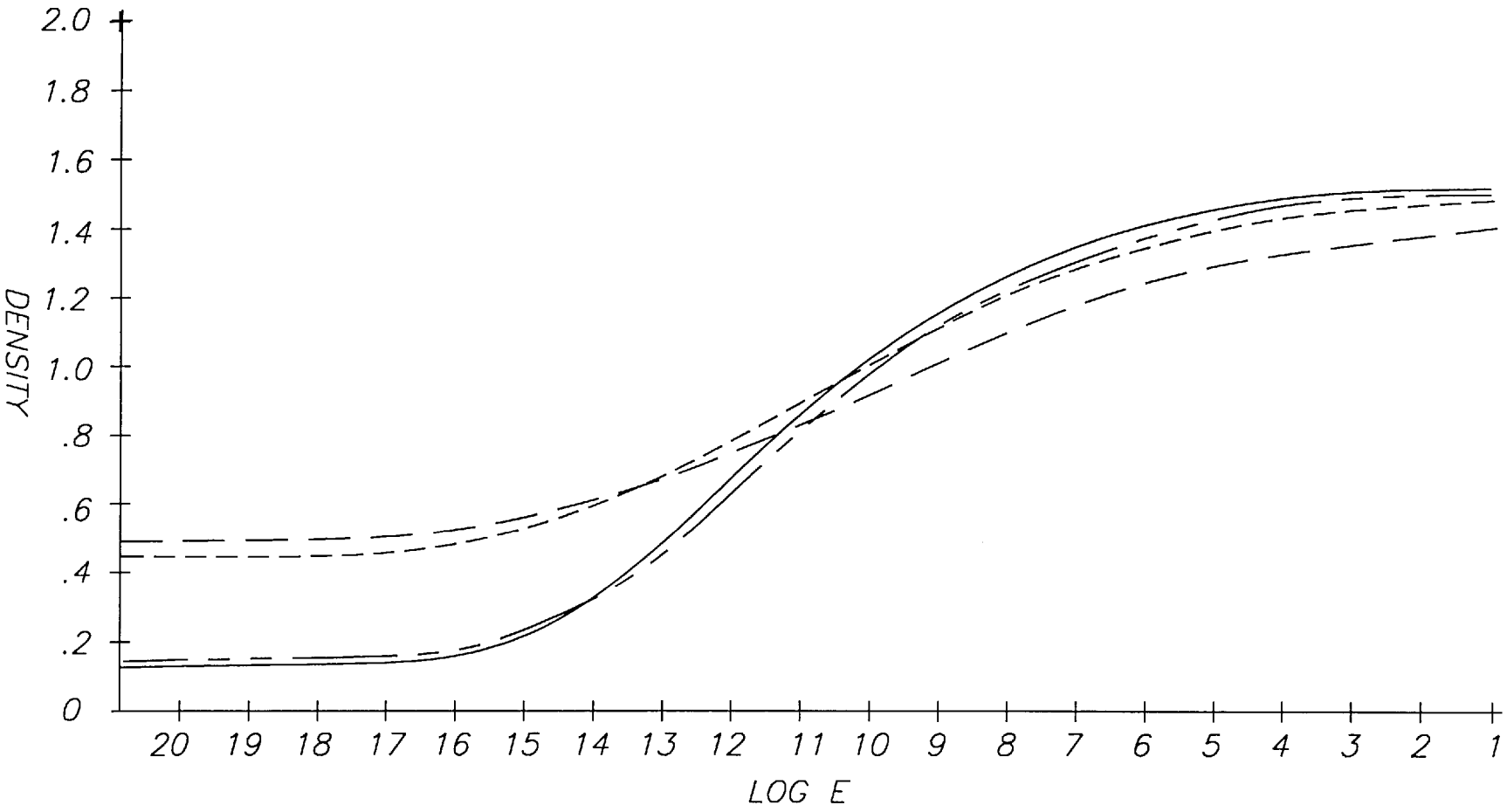

In this example, a control strip was run in the developer composition of Table 1 for 2.5 minutes. The result is shown FIG. 6, solid curve a.

A second strip was run in the N3-containing developer composition of Example 7, immediately after dissolving 10 mg/l of N3. The result is shown FIG. 6, small dashed curve d.

A comparison of the solid curve and small dashed curve shows that the fogging effect occurs.

A third strip was run in the N3-containing developer composition but 15 minutes after its dissolution. The result is shown FIG. 6, large dashed curve c.

A fourth strip was run in the N3-containing developer solution but 30 minutes after its dissolution. The result is shown FIG. 6 small-large dashed curve b.

It can be seen that after is minutes most of the fogging action remains. However, the compound N3 substantially decomposes in less than 30 minutes and then the developer solution behaves as if N3 had not been included.

The unique feature of this material is that it acts as a nucleator initially but then loses its activity after time of standing in the developer composition.

The N3 compound thus can advantageously be incorporated into the photographic material, carrying-out its fogging function when contacted with a composition containing a bi-nucleophilic agent. If any fogging compound washes out into the developer solution it is deactivated and so does not build up to unacceptable levels.

EXAMPLE 9

In this example, the material N2 was incorporated in an emulsion layer similar to that shown in coating structure (CN1). N2 was incorporated at three different levels 1, 10 and 100 $\mu$mol/m$^2$, represented on FIG. 7 by curves a, b and c respectively, d being a control with no N2.

These coatings were processed for 2.5 minute development time in the developer shown in Table 1, which contains hydroxylamine sulphate but does not contain compound N2. The rest of the process cycle was as shown previously.

Figure 7:
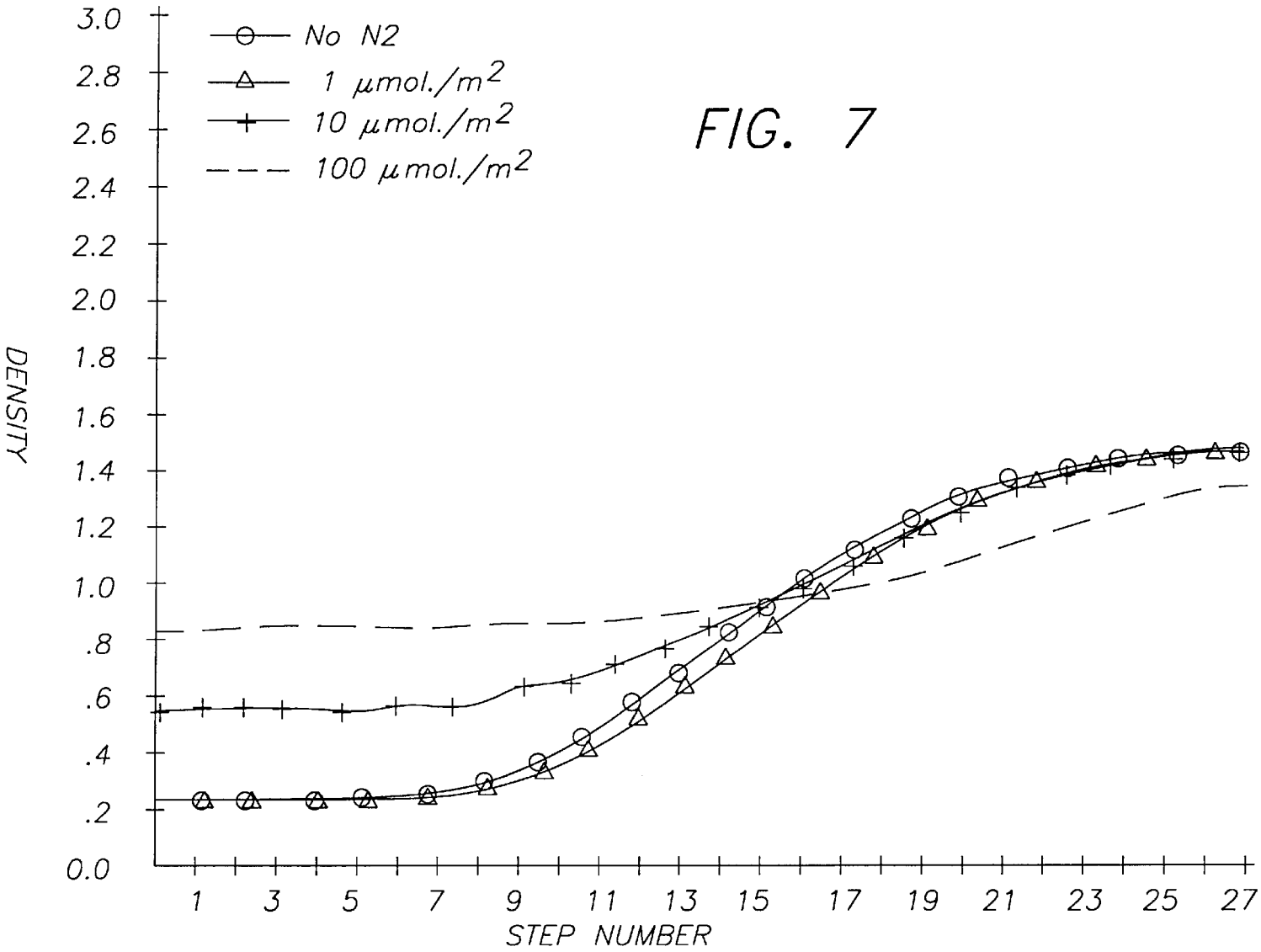

The results are shown in FIG. 7 where it can be seen that as the level of compound N2 is increased the level of fogging also increases.

This example shows that when N2 is incorporated in a photographic layer but not present in the developer solution, a similar fogging effect is observed to that when N2 is present in the developer solution but not in the photographic layer.

EXAMPLE 10

Figure 8:
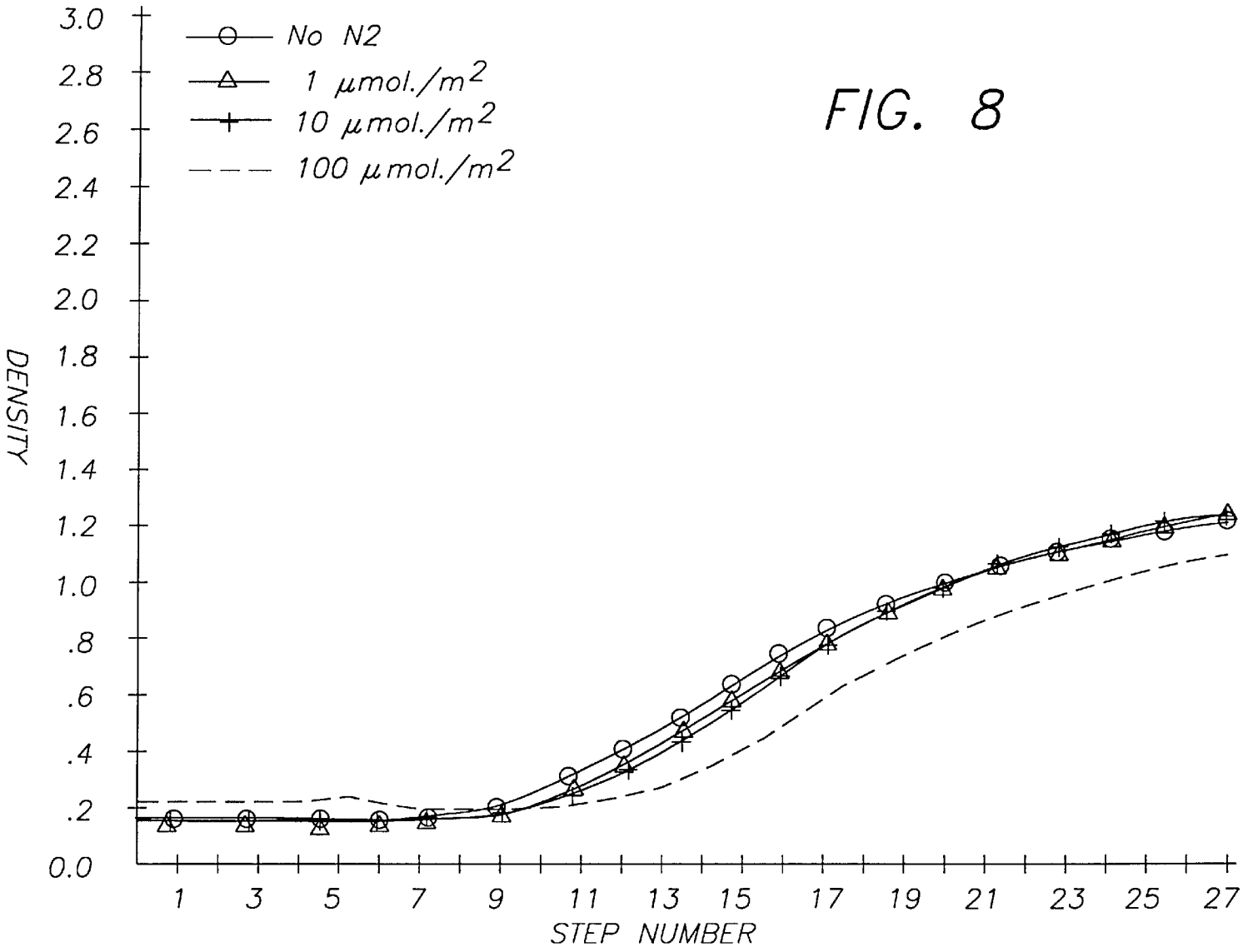

In this example, the experiment in Example 9 was repeated but now with hydroxylamine sulphate removed from the developer solution. It can be seen from FIG. 8 that the fogging effect is now not present and the effect of increasing levels of N2 in the coating is to retard development.

This shows that hydroxylamine sulphate is necessary for the fogging or nucleation effect to be observed when compound N2 is incorporated in the coating. This is a similar result to that found when N2 is present in the developer solution.

This confirms the general observation that materials like N2 are fogging agents in the presence of hydroxylamine sulfate but not in its absence whether they are incorporated in the coating or are present in the developer.

EXAMPLE 11

Synthesis of N1

N1 was prepared according to the reaction scheme shown below.

Preparation of (3)

The carboxylic acid (1) (12.0 g, 47.4 mmol) was stirred at room temperature in thionyl chloride (190 ml) for 4.5 h. The excess thionyl chloride was distilled off under reduced pressure to give a yellow syrup. Dry THF (150 ml) was added and the solvent evaporated off under reduced pressure; this process was repeated again and a yellow solid was obtained. The above solid was dissolved in dry THF (80 ml) and added dropwise to a solution of the hydroxy compound (2) (8.4 g, 45.9 mmol) and triethylamine (6.0 g, 59.4 mmol) in dry THF at ca. 7° C. After the addition was completed, the mixture was stirred overnight at room temperature and then poured into a mixture of ice/water (1.5 l) and conc. HCl (15 ml) with rapid stirring. The solid formed was collected by filtration under suction and washed with water (1.5 l). The product was dried over $P_2O_5$ under vacuum to give a cream colored solid. Yield 19.1 g (99%).

Preparation of (4)

A mixture of the nitro compound (3) (13.0 g, 31.1 mmol) and Pd/C (10%, 1.8 g) in THF (500 ml) was hydrogenated under 34 atm of hydrogen at 20° C. for 20 h. After removal of the catalyst by filtration and the solvent evaporated off under reduced pressure, a cream colored solid was observed. The crude solid was triturated with diethyl ether (300 ml), filtered and dried under vacuum to give the product (4) as a colorless solid. Yield 10.3 g (86%).

Preparation of (5)

The aniline (4) (8.0 g, 20.6 mmol) was added portionwise to a mixture of water (40 ml) and conc. HCl (96 ml) at room temperature with rapid stirring. After stirring for 0.5 h, acetic acid (80 ml) was added to the above suspension. The mixture was then cooled to 5° C. and an ice cold solution of sodium nitrite (1.64 g, 23.7 mmol) in water (8 ml) was added dropwise over 10 minutes. Stirring was continued for a further 20 minutes at 5° C. The mixture was filtered under suction, directly into a rapidly stirred solution of stannous chloride (16 g, 84.4 mmol) in conc. HCl (120 ml) and water (280 ml). The precipitate formed was collected by filtration under suction and washed with dilute HCl (250 ml) followed by water (100 ml). After drying over $P_2O_5$ under vacuum, the hydrazine hydrochloride (5) was obtained as a cream colored solid. Yield 8.5 g (93%).

Preparation of (6)

To a suspension of the hydrazine hydrochloride (5) (8.4 g, 19.1 mmol), in dry pyridine, was added dropwise 3-chloropivaloyl chloride (3.0 g, 19.1 mmol) at 7° C. with stirring. After the addition was completed, the mixture was stirred at room temperature for ca. 20 h and then poured into a mixture of ice/water (1 l) and conc. HCl (120 ml) with rapid stirring. The precipitate formed was collected by filtration under suction, washed with dilute HCl and water. After drying over $P_2O_5$ in a vacuum, the product (6) was obtained as a tan colored solid. Yield 9.0 g (97%).

Preparation of (N1)

To a suspension of palladium black (0.4 g) in 4.5% formic acid in THF (7 ml) was added a solution of (6) (0.4 g, 0.82 mmol) in the same solvent mixture (12 ml) under nitrogen, at room temperature, with stirring. After a period of 24 h, the palladium was filtered off and the solvent evaporated under reduced pressure to give a pink gum. The crude material was triturated with diethyl ether and the solid formed was collected by filtration under suction. The product (N1) was dried in vacuum and was isolated as a pink solid. Yield 0.23g (71%).

EXAMPLE 10

Synthesis of N3

N3 was prepared according to the reaction scheme shown below:

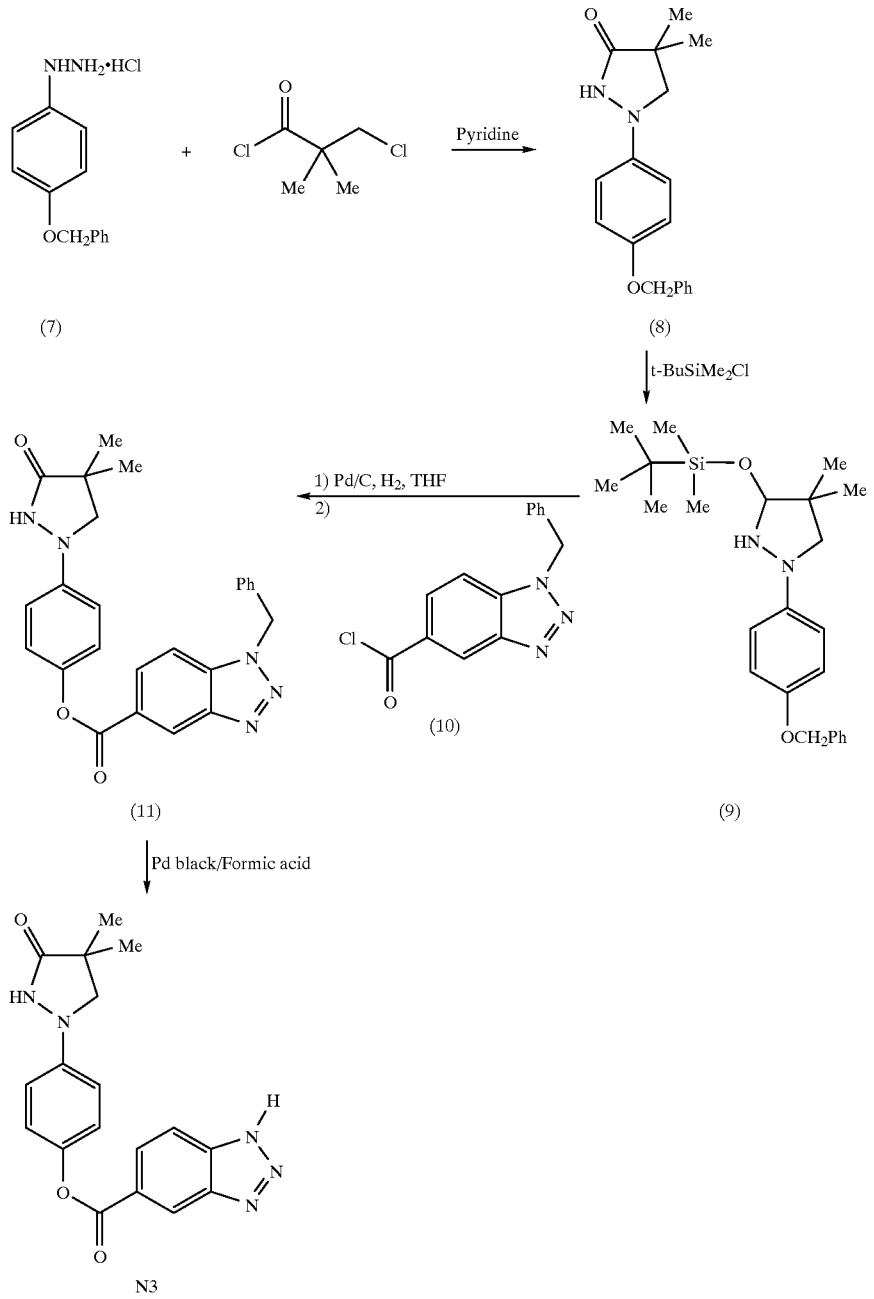

Preparation of (8)

To a suspension of the hydrazine hydrochloride (7) (14.0 g, 55.9 mmol) in dry pyridine (100 ml) was added 2-chloropivaloyl chloride (8.2 g, 53 mmol) at 10° C. over a period of 15 minutes. The reaction mixture was then stirred at room temperature for 20 h and then poured into a mixture of ice/water (11) and conc. HCl with rapid stirring. The yellow/brown solid was collected by filtration under suction and dried over $P_2O_5$ in a vacuum oven. The crude was triturated with diethyl ether and then dried under vacuum to give compound (8) as a cream colored solid. Yield 14.1 g (85%).

Preparation of (9)

To a suspension of (8) (3.0 g, 10.14 mmol) in dry toluene (35 ml) and dry THF (12 ml) was added t-butyl dimethylsilyl chloride (1.68g, 11.1 mmol) under nitrogen, at room temperature with stirring. This was followed by the addition of triethylamine (1.12 g, 11.1 mmol), N,N-dimethylaminopyridine (0.05 g) and 1,8-diazabi-cyclo (5.4.0)undec-7-ene (3 drops). The whole suspension was heated to reflux for 20 h. After cooling to room temperature, the mixture was filtered under suction and washed with diethyl ether. The solvent was removed from the filtrate under reduced pressure to give a yellow oil (4.5 g). Purification by column chromatography gave the required product (9) as a waxy solid. Yield 4.0 g (97%).

Preparation of (11)

A solution of (9) (2.4 g, 5.8 mmol) in THF (250 ml) was hydrogenated over palladium on charcoal (10%, 0.5 g) under 34 atmosphere of hydrogen gas at room temperature for 24 h. After removal of the catalyst by filtration, the filtrate was cooled to ca. 5° C. and then treated with triethylamine (0.6 g, 5.8 mmol) followed by dropwise addition of a solution of the acid chloride (10) (5.8 mmol). The acid chloride (10) was prepared from the corresponding acid (1.47 g, 5.8 mmol) and thionyl chloride (20 ml). After the addition was completed, the mixture was stirred at room temperature for ca. 20 h. The mixture was then filtered and the filtrate concentrated under reduced pressure. The crude material was dissolved in ethyl acetate (200 ml) and washed with 3N HCl (2×150 ml) followed by brine (100 ml). The organic solution was dried over $MgSO_4$, filtered and the solvent removed under reduced pressure to give a yellow gum (ca. 3 g). Purification of the crude by column chromatography gave the required product (11) as a cream colored solid. Yield 1.34 g (52%).

Preparation of (N3)

An ice cold solution of formic acid in THF (4.5%, 10 ml) was added to palladium black (0.7 g) under nitrogen. To the above suspension was added dropwise a solution of (11) (0.65 g, 1.48 mmol) in 4.5% formic acid solution in THF (20 ml). The reaction mixture was stirred under nitrogen at room temperature for 24 h. The catalyst was removed by filtration and the filtrate evaporated to dryness under reduced pressure to give a yellow solid (0.53 g). The crude yellow solid was triturated with acetonitrile (30 ml) at room temperature, filtered and dried under vacuum to give the required product (N3) as a cream colored solid. Yield 0.34 g (65%).

The invention has been described in detail with particular reference to certain preferred embodiments thereof, but it will be understood that variations and modifications can be effected within the spirit and scope of the invention.

We claim:

1. A photographic processing solution for a reversal process comprising a compound (I) and a bi-nucleophilic agent, wherein the compound (I) corresponds to the following formula:

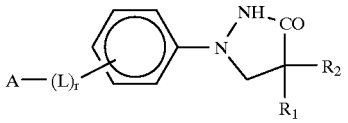

wherein

A is a group capable of being adsorbed to the silver halide surface,

L is a linking group and r is 0 or 1, $R_1$ and $R_2$ are independently selected from an alkyl group, substituted or unsubstituted, and an aryl group substituted or unsubstituted.

2. The solution of claim 1 wherein $R_1$ and $R_2$ are independently an alkyl group having from 1 to 12 carbon atoms, substituted or unsubstituted.

3. The solution of claim 1 wherein the alkyl group is selected from methyl, ethyl and propyl.

4. The solution of claim 1 wherein A is selected from thiourea, triazoles, benzotriazoles, mercaptotetrazoles, mercaptoimidazoles, mercaptothiazoles, mercaptooxazoles, mercaptotriazoles, indazoles, imidazoles, benzimidazoles and thioethers.

5. The solution of claim 1 wherein L is selected from the group consisting of alkylene, —CO—, —CO—O—, —O—CO—, —CONR—, —NRCO—, —$SO_2$NR—, —NR$SO_2$—, where R=H, alkyl or aryl; —O—; —O—$(CH_2)_n$—O— and —O—$(CH_2)_n$—O—CO—, where n=1–5.

6. The solution claim 1 wherein L is the group —O—CO, the linking group being hydrolyzable in a developer solution.

7. The solution claim 1 wherein the bi-nucleophilic agent is selected from hydroxylamine and hydrogen peroxide.

8. The solution claim 1 wherein the amount of the bi-nucleophilic agent is in the range from $1\times10^{-3}$ M to 0.3 M.

9. The solution claim 1 wherein the amount of compound (I) is in the range from $3\times10^{-7}$ M to $3\times10^{-}$M.

10. The solution claim 1 wherein the solution is a color developing solution.

11. The solution according to claim 1 wherein the solution is a reversal solution.

12. A process of producing a positive photographic image by imagewise exposure of a photographic reversal silver halide material, comprising the step of contacting the photographic material with a solution as defined in claim 1.

* * * * *